US010584716B2

(12) United States Patent
Henner et al.

(10) Patent No.: US 10,584,716 B2
(45) Date of Patent: Mar. 10, 2020

(54) AERODYNAMICALLY AND ACOUSTICALLY IMPROVED CAR FAN

(71) Applicant: Valeo Systemes Thermiques, Le Mesnil Saint-Denis (FR)

(72) Inventors: Manuel Henner, Le Mesnil Saint Denis (FR); Bruno Demory, Le Mesnil Saint Denis (FR); Youssef Beddadi, Le Mesnil Saint Denis (FR); François Franquelin, Le Mesnil Saint Denis (FR); Charles Roland, Le Mesnil Saint Denis (FR)

( * ) Notice: Subject to any disclaimer, the term of this patent is extended or adjusted under 35 U.S.C. 154(b) by 0 days.

(21) Appl. No.: 15/559,634

(22) PCT Filed: Mar. 21, 2016

(86) PCT No.: PCT/EP2016/056139
§ 371 (c)(1),
(2) Date: Sep. 19, 2017

(87) PCT Pub. No.: WO2016/146850
PCT Pub. Date: Sep. 22, 2016

(65) Prior Publication Data

US 2018/0051712 A1 Feb. 22, 2018

(30) Foreign Application Priority Data

Mar. 19, 2015 (FR) ..... 15 52271

(51) Int. Cl.
*F04D 29/38* (2006.01)
*F04D 29/32* (2006.01)

(52) U.S. Cl.
CPC ..... *F04D 29/386* (2013.01); *F04D 29/326* (2013.01)

(58) Field of Classification Search
CPC ..... F04D 29/386; F04D 29/326
(Continued)

(56) References Cited

U.S. PATENT DOCUMENTS 6,065,937 A * 5/2000 Hunt ..... F04D 29/326 416/169 A
7,762,769 B2 * 7/2010 Stevens ..... F04D 29/326 415/220

(Continued)

FOREIGN PATENT DOCUMENTS

| | | |
|---|---|---|
| EP | 0 933 534 A2 | 8/1999 |
| FR | 2 965 314 A1 | 3/2012 |
| KR | 10 0798 103 B1 | 1/2008 |

OTHER PUBLICATIONS

International Search Report issued in PCT/EP2016/056139 dated Jun. 8, 2016 (2 pages).

(Continued)

*Primary Examiner* — Joseph J Dallo
*Assistant Examiner* — Yi-Kai Wang
(74) *Attorney, Agent, or Firm* — Osha Liang LLP

(57) ABSTRACT

A ventilation blower wheel may have a hub and blades extending radially outwards from the hub between a blade root and a blade tip. Additionally, the blades of said blower wheel may have a backward/forward curvature as a result of a reversal in curvature along their span. Furthermore, said blades may have, between 20% and 80% along their span, at least one pitch variation, extending over a maximum span distance of 25%, of at least 2° more or less than a linear pitch over said span distance.

18 Claims, 5 Drawing Sheets

(58) Field of Classification Search
USPC ..... 123/41.63
See application file for complete search history.

(56) References Cited

U.S. PATENT DOCUMENTS

2006/0165526 A1* 7/2006 Cho ..... F04D 29/384
415/220
2013/0323062 A1* 12/2013 Henner ..... F04D 29/384
416/195

OTHER PUBLICATIONS

Written Opinion of the International Searching Authority issued in PCT/EP2016/056139 dated Jun. 8, 2016 (6 pages).

* cited by examiner

AERODYNAMICALLY AND ACOUSTICALLY IMPROVED CAR FAN

BACKGROUND

The present invention concerns the field of cars, and in particular that of the circulation of air for cooling the engine equipment.

Vehicles that have a heat engine need to discharge the calories that they generate during operation, and are equipped for this purpose with heat exchangers, in particular coolers, which are generally positioned at the front of the vehicle and through which outside air passes. A fan is positioned upstream or downstream in order to force this air to circulate through the exchanger or exchangers. The ventilation blower wheel that forces the air to circulate has a flow oriented in an axial direction. It comprises blades that are connected by the root to a central hub, and generally held together at the tip by a rotating guide (as shown in FIG. 1).

It is also usual to give the blades curvature effects in order to improve their acoustics. The curvature is referred to as forward curvature if the blade is curved in the direction of rotation, considered according to the plane perpendicular to the axis of rotation; otherwise, it is referred to as backward curvature. Using the curvature effects, the acoustic sources that are located along the span of the blade are phase-shifted from each other, and tonal noise reductions of several decibels can be observed.

In addition to having beneficial acoustic effects, curvature also modifies the aerodynamic properties, because it produces forces perpendicular to the blade surface, said forces in turn creating radial flows. Generally, for a given operating point, backward curvature will produce a flow extending radially outwards, while forward curvature has the effect of contracting the flow (as will be explained in greater detail in relation to FIG. 2). Therefore, backward curvature works more at the tip, and promotes efficiency at high flow rates, while forward curvature promotes low flow rates, working more at the root.

However, from an aeroacoustic point of view, the advantages are reversed and backward curvature produces more noise at a high flow rate owing to the greater amount of work at the tip, while forward curvature produces more noise at a low flow rate owing to the greater amount of work at the root. It is therefore observed that the benefits of a (forward or backward) curvature effect are antagonistic and that, owing to this effect, it is not possible to achieve both satisfactory aerodynamic efficiency and satisfactory acoustic quality in a same operating range (low or high flow rate).

Mixed solutions incorporating backward curvature and forward curvature are therefore an often-used compromise. These mixed backward/forward curvatures have the effect of contracting the flow, which centers approximately at the mid-span point (see FIG. 2). However, owing to these particular mid-span flow conditions, the pressure gradient between the trailing edge and the leading edge is modified, and significant separation is observed on the suction face of the blade, originating in this mid-span area.

There is therefore a need to design improved blower wheels that are capable of producing high aerodynamic efficiency without suffering a drop in aeroacoustic performance.

SUMMARY OF DISCLOSURE

To this end, the invention concerns a ventilation blower wheel comprising at least one hub and blades extending radially outwards from the hub between a blade root and a blade tip, the blades of said blower wheel having a backward/forward curvature as a result of a reversal in curvature along their span.

According to the invention, said blades comprise at least one sudden variation in pitch extending over a limited span distance, said pitch variation being located close to a curvature reversal point of the blades. A "sudden" variation refers preferably to at least 2° more or less relative to a linear pitch over said span distance. A "limited" span distance refers preferably to a maximum span distance of 25% of the total span of the blade. A variation located "close" to a curvature reversal point of the blades refers to a position located preferably between 20% and 80% along their span. Advantageously, the pitch variation is between 3° and 5°.

This pitch inflection, compared to a blade that has continuous pitch evolution along its span, helps prevent the separation of the air flow from the blade and therefore to prevent both noise pollution and drops in efficiency caused by this separation.

A peak in the pitch variation is preferably positioned at a distance less than or equal to 30% of the span of the blade, relative to the curvature reversal point. The proximity of this peak to the curvature reversal point allows it to act as close as possible to the location where separation occurs, thus improving its effectiveness.

More preferably, said distance is less than or equal to 10% of the span of the blade.

In one particular embodiment, the pitch variation is referred to as positive, the pitch value being greater than said linear pitch over the whole span distance.

In another particular embodiment, the pitch variation is referred to as negative, the pitch value being less than said linear pitch over the whole span distance.

Advantageously, the pitch variation has a positive or respectively negative slope, until its peak, followed by a negative or respectively positive slope. This pointed shape represents an optimum in terms of efficiency in eliminating flow separation that is generally observed on the suction face.

Preferably, at least one of the pitch variation slopes has, as an absolute value, a value higher than 1° per 10% span variation. The other slope preferably has, as an absolute value, a value less than 1° per 10% span variation.

Advantageously, the curvature of the blades at the curvature reversal point is between −4° and −25°.

In one particular embodiment, the variation in curvature between the reversal point and the tip of the blades is between 4° and 25°.

Preferably, the curvatures of the blades at the root and at tip differ by less than 10°. More preferably, said curvatures are both less than 10°.

The invention also concerns an engine fan comprising a blower wheel as described above and a cooling system comprising such an engine fan. Such a system can comprise one or more heat exchangers through which the air flow generated by the blower wheel passes.

BRIEF DESCRIPTION OF DRAWINGS

The invention will be more clearly understood, and other aims, details, features and advantages of same will become clearer on reading the detailed explanatory description that follows, of one embodiment of the invention provided as a purely illustrative and non-limiting example, with reference to the appended schematic drawings.

In these drawings.

DETAILED DESCRIPTION

Figure 1:
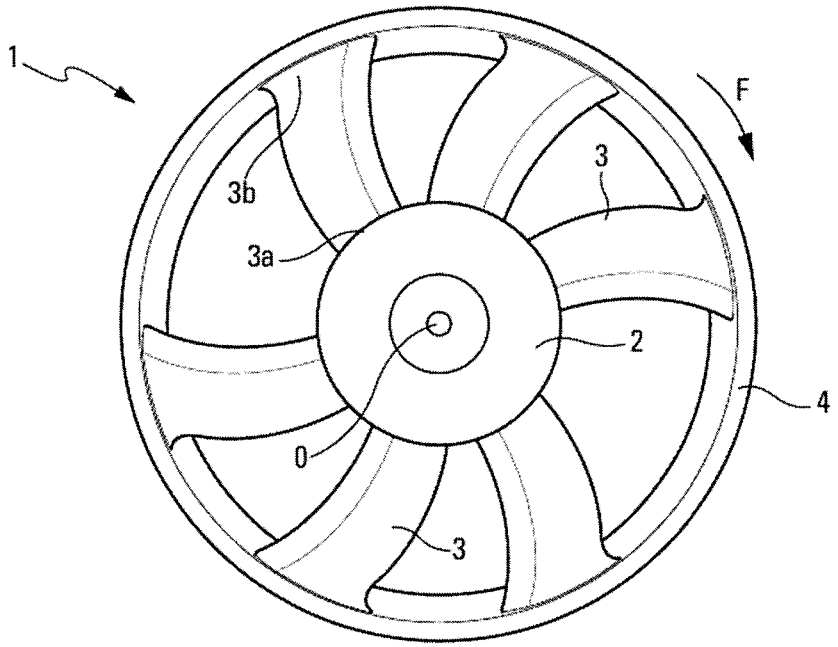
FIG. 1 is a front view of a blower wheel according to the prior art.

FIG. 1 shows a blower wheel 1, from the prior art, that is mounted in rotation about an axis passing through its center O and oriented here in a direction orthogonal to the plane of the figure. The direction of rotation of the blower wheel 1 is indicated by the arrow F. When the blower wheel 1 is rotated, for example by an electric motor (not shown), the blower wheel 1 swirls the air passing through it. The air flow then flows in a direction of flow oriented in a substantially axial direction.

Hereinafter, the terms "upstream" and "downstream" are used in reference to the direction of flow of the flow of air. The terms "axial", "radial" or "tangential" refer to the axis of rotation of the blower wheel.

Said blower wheel 1 comprises:

- a central hub 2, advantageously intended to cover the motor driving the blower wheel,
- a plurality of blades 3 (in this case, six), their first ends, or roots 3*a*, being attached to the hub 2 and extending radially from said hub,
  - and, although this element is not compulsory, a peripheral rotating guide 4 in the form of a cylindrical ring, to which the second ends, or tips 3*b*, of the blades 3, are attached.

The blades 3 are generally identical to each other and can have a cross-section substantially in the shape of an aircraft wing, with a suction face and a pressure face. They therefore extend in a transverse direction between, respectively, a leading edge that comes into contact first with the air flow when the blower wheel 1 rotates, and an opposing trailing edge.

In a cross-section of the blade in a plane parallel to the axis of rotation, perpendicular to the line connecting the mid-chord points, the line connecting the leading edge to the trailing edge is referred to as the chord line, whereas the line connecting the points equidistant from the suction face and the pressure face of the blade is referred to as the camber line. The aerodynamic characteristics of a blade are defined by the following parameters, which evolve along the whole length of the blade:

- its chord, which is the length of the chord line, expressed in mm,
- its camber, which is the maximum value of the distance between the chord line and the camber line, added to the length of the chord line and expressed as a percentage,
- its pitch, which is the angle made by the chord line with the axis of rotation of the blower wheel (N.B.: by convention, in this text, the pitch angle is the complementary angle of the pitch angle typically defined in aerodynamics).

A fourth characteristic which influences its aerodynamic performances is the curvature of the line that connects the mid-chord points of the blade, projected on a radial plane. The curvature of the blade is referred to as forward curvature if, for the chord in question, the tangent to this line is oriented, moving from the root to the tip, in the direction of rotation F; otherwise, it is referred to as backward curvature. The curvature, at each mid-chord point along the span, is expressed by the value, in degrees, of the angle made by the radius at this point with the radius of the mid-chord point at the blade root.

Figure 2:
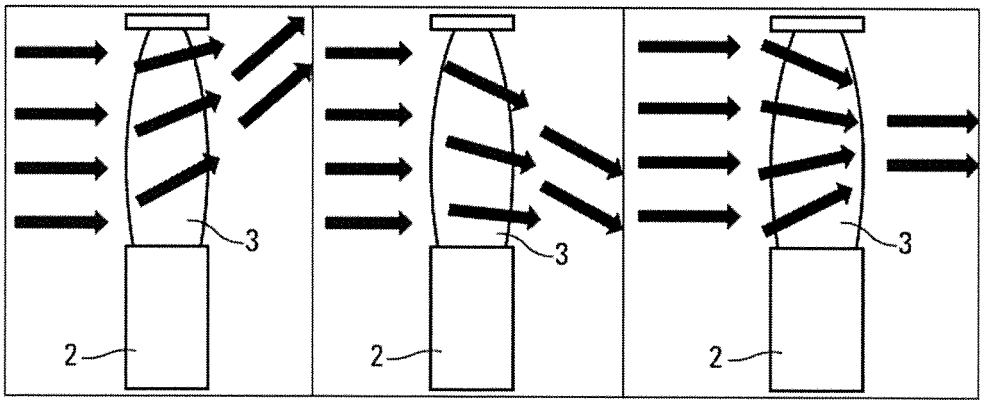
FIG. 2 is a schematic view showing the shape of the air flow passing through a blower wheel according to FIG. 1, showing the respective cases of blades having backward curvature, forward curvature and mixed backward/forward curvature.

FIG. 2 shows the deviation of a fluid passing through the blower wheel 1 in the respective cases of its blades 3 having backward curvature, forward curvature and mixed backward/forward curvature.

In the left-hand figure, the backward curvature produces a flow that extends radially outwards, whereas the central figure shows that forward curvature gives the flow a centripetal deviation. In the right-hand figure that corresponds to mixed backward/forward curvature, the two previous effects neutralize each other and together hold an axial direction, with a contraction of the flow that centers approximately in a mid-span area. However, owing to these particular mid-span flow conditions, the pressure gradient between the trailing edge and the leading edge is modified, and significant separation can be observed on the suction face of the blade 3, originating substantially in the mid-span area. It is this separation effect that the invention proposes to reduce, acting in particular on the distribution of the pitch along the span of the blade, and especially in the vicinity of this mid-span point.

Figure 3:
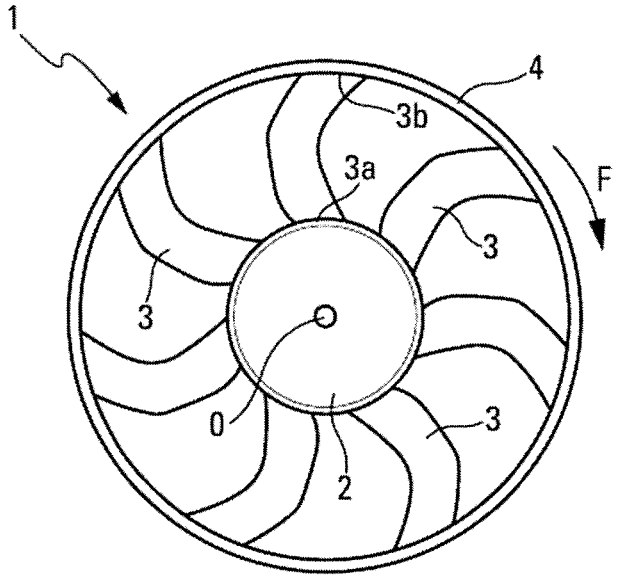
FIG. 3 is a front view of a blower wheel with mixed backward/forward curvature.

FIG. 3 shows a blower wheel 1 whose blades 3 have mixed curvature, with backward curvature at the root 3*a* and then forward curvature from the mid-span area to the tip 3*b*.

Figure 4:
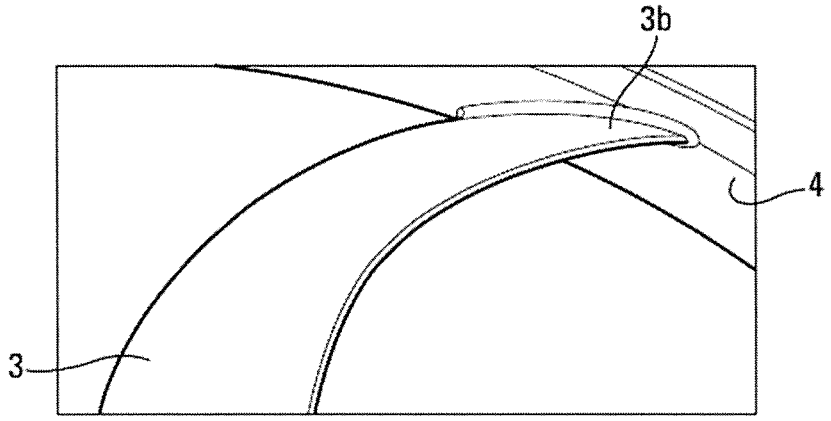
FIG. 4 is a perspective view of a blade of the blower wheel of FIG. 3, according to the prior art.

FIG. 4 shows a blade according to the prior art from the blower wheel of FIG. 3. The pitch of the blade 3 varies continuously along its span, without sudden variation.

Figure 5:
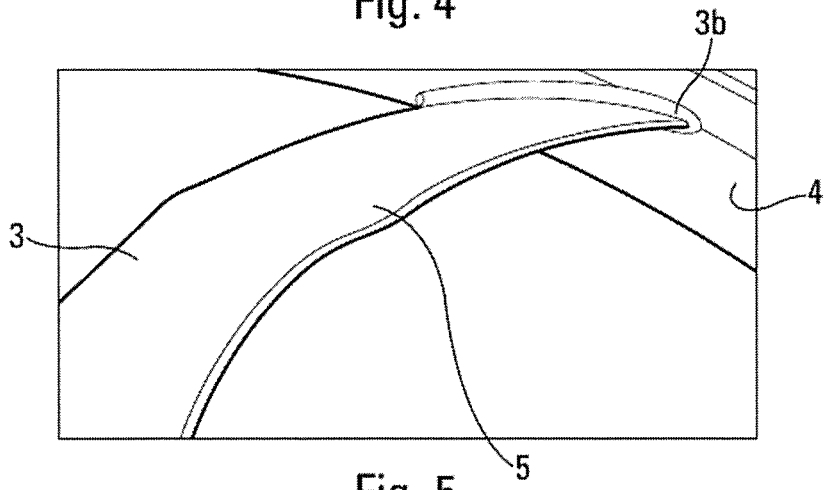
FIG. 5 is a perspective view of a blade of the blower wheel of FIG. 3, modified according to the invention.

However, FIG. 5 shows a blower wheel blade 3 according to the invention, whose pitch has an inflection peak 5 at the point of the span where the curvature is reversed, i.e. where the flow contraction effect is located. The positioning, shape and intensity of this peak 5 are provided in FIGS. 6 to 8.

Figure 6:
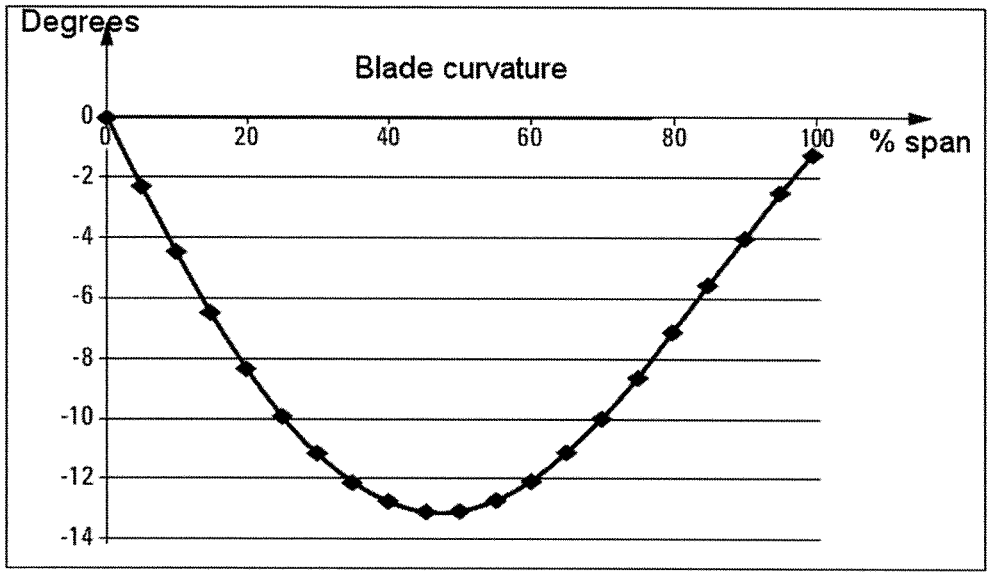
FIG. 6 is a schematic view showing the evolution in the curvature of the blade of FIG. 5 along its span.

FIG. 6 shows the evolution in the curvature in the case of mixed backward/forward curvature. The curvature is zero at the blade root 3*a*, meaning that the line of points located mid-chord moves away from the hub 2 in a perpendicular direction. The curvature increases in the backward direction until it reaches a maximum backward value of −13°, in the example shown, positioned in the mid-span area. From this point, the blade 3 shifts to forward curvature, reducing its curvature gradually from −13° to 0°, which it reaches, for example, at the blade tip 3*b*. The curve shown in the figure corresponds to the simplest shape that can be envisaged for a mixed-curvature blade, with the aim of illustrating the invention; however, it is not limited to these geometrically simple shapes.

Figure 7:
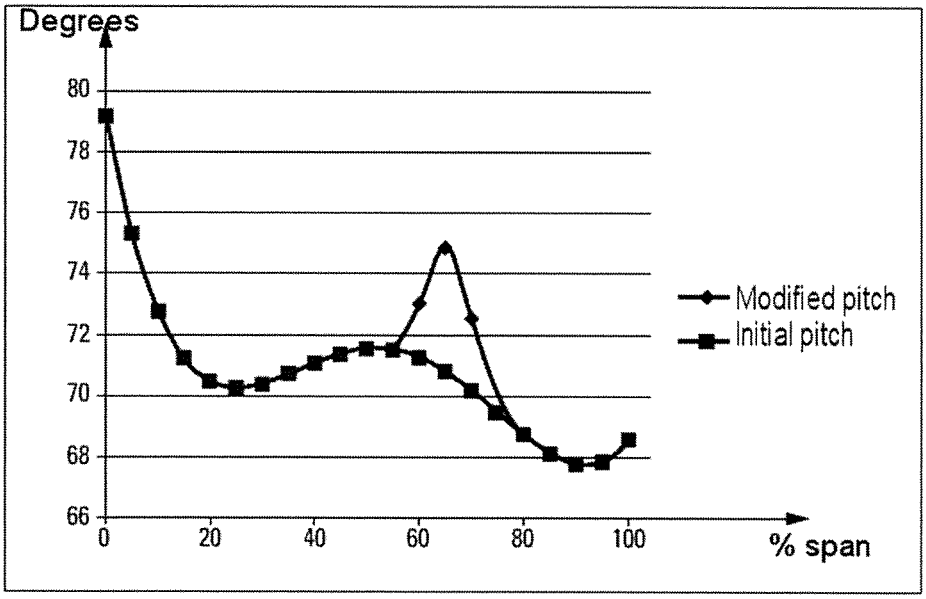
FIG. 7 is a schematic view showing the evolution in the pitch of the blade of FIG. 5 along its span, respectively according to a first embodiment of the invention and according to a reference embodiment.
Figure 8:
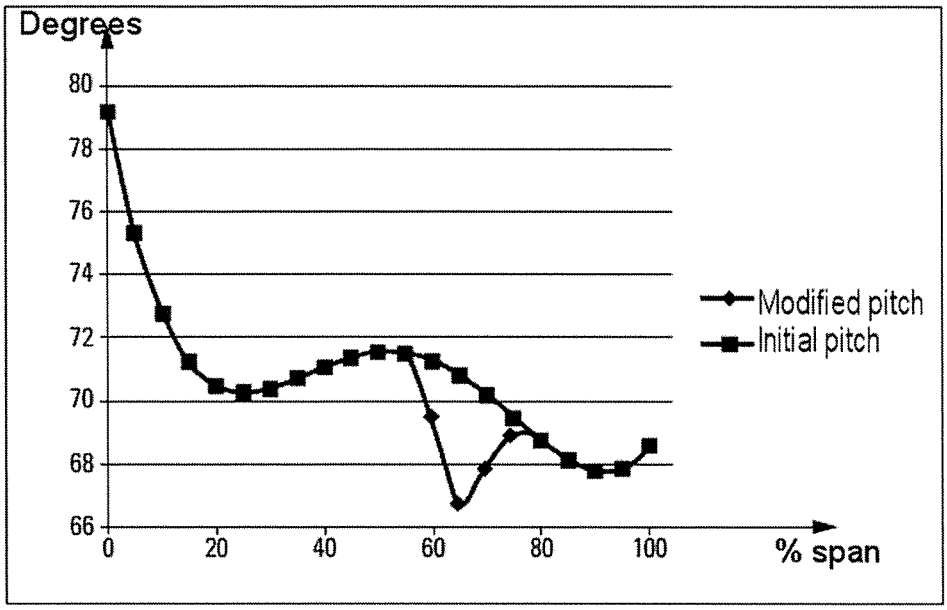
FIG. 8 is a schematic view showing the evolution in the pitch of the blade of FIG. 5 along its span, respectively according to a second embodiment and according to a reference embodiment.

FIGS. 7 and 8 show the evolution of the pitch along the span of a blade 3, in a version of a reference blower wheel (pitch referred to as initial pitch) and, respectively, in two embodiments of the invention (pitch referred to as modified pitch). The invention is characterized by an inflection in the pitch forming a pitch peak 5; this peak is located in this case 50% along the span, i.e. exactly around the curvature reversal point. This inflection is either positive (FIG. 7) or negative (FIG. 8). However, in both cases, it has a large amplitude, with the slope of the inflection being greater than or equal to 1° per 10% curvature variation, as an absolute value. The preferred values given in the version shown in the figures and provided as examples are 3° and 5° per 10% pitch variation, depending on whether the slope is ascending or descending and depending on whether the initial pitch curve is itself decreasing or increasing around the curvature reversal point. For example, the curvature can have slopes of the same absolute value to either side of the reversal point.

Figure 9:
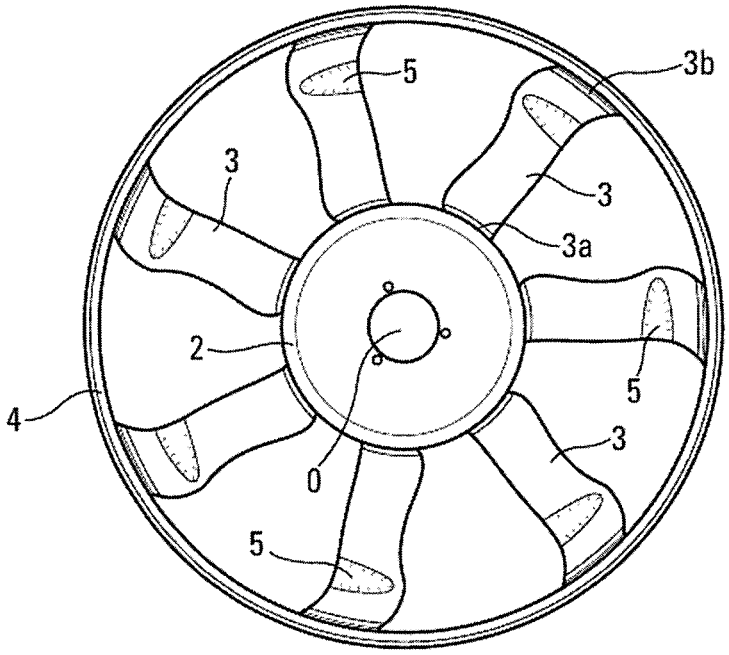
FIG. 9 is a front view of a blower wheel in a first implementation of the invention.
Figure 10:
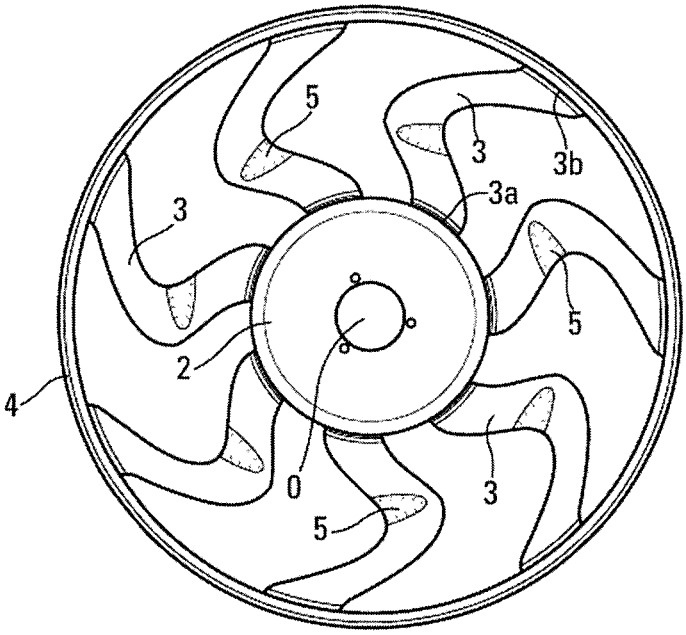
FIG. 10 is a front view of a blower wheel in a second implementation of the invention.
Figure 11:
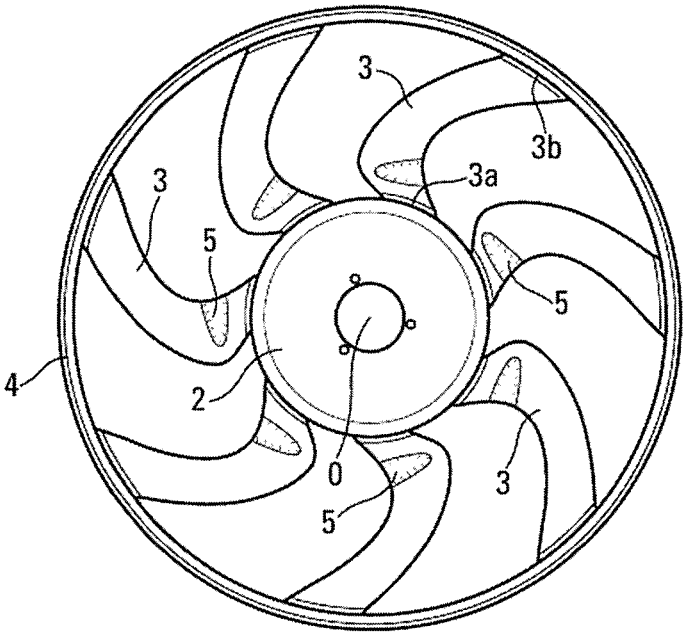
FIG. 11 is a front view of a blower wheel in a third implementation of the invention.

FIGS. 9 to 11 show three implementations of the invention on mixed curvature blower wheels.

In FIG. 9, the curvature is backward/forward with zero curvatures at the root 3*a* and at the tip 3*b* and a curvature reversal located 75% along the span. At this point, the curvature is equal to −4°.

In FIG. 10, the curvature is backward/forward with zero curvatures at the root 3*a* and at the tip 3*b* and a curvature reversal located 50% along the span. At this point, the curvature is equal to −25°.

In FIG. 11, the curvature is backward/forward with zero curvatures at the root 3*a* and curvatures equal to 7° at the tip 3*b*. The curvature reversal is located 20% along the span, and at this point the curvature is equal to −30°.

It can therefore be seen that the invention, i.e. the positioning of a pitch reversal or peak 5, can be implemented on any type of blower wheel having mixed backward/forward curvature, with a wide range of possible values for the curvature at the root, the curvature at the tip and the position of the curvature reversal along the span.

The invention preferably concerns backward/forward curvature:

- in which the reversal is located between 20% and 80% along the span of the blade,
- in which the curvature has, at said reversal point, a value of between −4° and −25°,
- and in which the variation in curvature between the reversal point and the tip is between 4° and 25°.

Advantageously, the curvature at the root and at the tip are similar to each other, i.e. with a difference less than or equal to 10°, and more preferably are both close to zero, i.e. less than 10°.

Combined with this curvature, the value of the pitch of the blade 3 varies suddenly, over a limited length of span. This means that the pitch deviates, over a given segment of the span of the blade, from the existing linear pitch, between the two end points of this segment. This pitch variation is advantageously defined as follows, according to the invention.

The pitch variation is located in an area of the span close to the point of maximum backward curvature. The span distance between the point of maximum curvature and the inflection peak 5 is less than or equal to 30% of the span, and more preferably less than or equal to 10%.

The inflection peak 5 consists of a sudden variation in the pitch, of at least 2° over a maximum variation of 25% of the span. Preferably, this variation is between 3° and 5°.

Preferably, the pitch is located on the same side with respect to said linear pitch, over the whole span distance, whether above or below.

In a first embodiment, the sudden variation in pitch has a positive slope of more than 1° per 10% pitch variation, until an inflection peak 5 is reached, and then, from this peak, a negative slope of less than −1° per 10% pitch variation. In a second embodiment, it first has a negative slope of less than −1° per 10% pitch variation, then a positive slope of more than 1° per 10% pitch variation.

Finally, the invention is shown with blades 3 that have only a single inflection peak 5; in alternative versions, several peaks can be present along the span of the blade 3, at least one of them having the minimal characteristics described above.

With respect to performances, the geometry proposed for the blade 3 by the present patent application tends to achieve an optimum result both in aerodynamic and aeroacoustic terms. The desired aims are to achieve good efficiency, to minimize the acoustic effects and to minimize the deflection at the blade tips 3*b*.

The geometry is based primarily on mixed backward/forward curvature, and on a law governing the distribution of the pitch along the span that is adapted to the three-dimensional nature of the flow. Improved performances are obtained owing to a shape inflection that is positioned in the vicinity of the span where the curvature reverses. The effect of this inflection is to locally modify the angle of attack of the incident flow on the aerodynamic profile and thus improve flow over the suction face and minimize separation. Using this improved design, the drag of the profile is reduced with no change in lift, and separation is eliminated, improving the acoustics by minimizing the noise caused by interaction between the blower wheel and its support. An improvement in terms of the aerodynamic performances can be seen, in the example of the blower wheel in FIG. 3, with an efficiency that increases from 43.8% to 45.2%, at the same speed of rotation and flow rate.

Finally, using the pitch variations described in the present patent application helps obtain ventilation blower wheels for cars that offer a very good trade-off between aerodynamics, acoustics and the effects of structural deflection.

The invention has been described in the case of a blower wheel having a rotating guide 4 linking the outer end 3*b* of the blades. Obviously, it can equally be made without a rotating guide, provided the shape given to the blades 3 is as described above.

The invention also concerns an engine fan comprising such a blower wheel, and its drive motor. Said fan can also comprise a nozzle provided with an air passage opening inside which the blower wheel rotates about its axis, said drive motor being carried by the nozzle via radial arms that advantageously form stator blades.

The invention also concerns a system or module for cooling a car engine set. It comprises, in particular, the engine fan disclosed above and a cooler. The blower wheel can be located between the cooler and the engine set or upstream from said cooler. These elements are, for example, substantially aligned along the axis of rotation of the blower wheel.

What is claimed:

1. A ventilation blower wheel comprising:

a hub; and blades extending radially outwards from the hub between a blade root and a blade tip, the blades of said ventilation blower wheel having a backward/forward curvature from a reversal in curvature along a span distance of said blades, wherein the span distance is a length from the blade root to the blade tip, wherein said blades comprise, between 20% and 80% along said span distance, at least one pitch variation, extending over a maximum span distance of 25%, of at least 2° more or less than a linear pitch over said span distance, and wherein a peak in the at least one pitch variation is positioned a distance from a curvature reversal point, wherein the distance is measured to equal a length less than or equal to 30% of the length of the span distance.

2. The ventilation blower wheel as claimed in claim 1, wherein the at least one pitch variation is between 3° and 5°.

3. The ventilation blower wheel as claimed in claim 1, wherein said distance is less than or equal to 10% of the span distance of the blades.

4. The ventilation blower wheel as claimed in claim 1, wherein the at least one pitch variation is referred to as positive, a pitch value being greater than said linear pitch over all of the span distance.

5. The ventilation blower wheel as claimed in claim 1, wherein the at least one pitch variation is referred to as negative, a pitch value being less than said linear pitch over all of the span distance.

6. The ventilation blower wheel as claimed in claim 4, wherein the at least one pitch variation has a positive or respectively negative slope, until a peak of said slope, followed by a negative or respectively positive slope.

7. The ventilation blower wheel as claimed in claim 6, wherein at least one of the at least one pitch variation slopes has, as an absolute value, a value of more than 1° per 10% span variation.

8. The ventilation blower wheel as claimed in claim 7, wherein the other slope has, as an absolute value, a value less than 1° per 10% span variation.

9. The ventilation blower wheel as claimed in claim 1, wherein the backward/forward curvature of the blades at the curvature reversal point is between −4° and −25°.

10. The ventilation blower wheel as claimed in claim 1, wherein a variation in the backward/forward curvature between the curvature reversal point and the blade tip of the blades is between 4° and 25°.

11. The ventilation blower wheel as claimed in claim 1, wherein the backward/forward curvatures of the blades at the blade root and at the blade tip differ by less than 10°.

12. The ventilation blower wheel as claimed in claim 11, wherein said backward/forward curvatures are both less than 10°.

13. An engine fan, the engine fan comprising:

a drive motor; and a blower wheel, the blower wheel comprises:

a hub; and blades extending radially outwards from the hub between a blade root and a blade tip, the blades of said ventilation blower wheel having a backward/forward curvature from a reversal in curvature along a span distance of said blades wherein the span distance is a length from the blade root to the blade tip, wherein said blades comprise, between 20% and 80% along said span distance, at least one pitch variation, extending over a maximum span distance of 25%, of at least 2° more or less than a linear pitch over said span distance, and wherein a peak in the at least one pitch variation is positioned a distance from a curvature reversal point, wherein the distance is less than or equal to 30% of the span distance of the blades.

14. A car cooling system, the car cooling system comprising:

an engine fan, the engine fan comprises:

a drive motor; and a blower wheel, the blower wheel comprises:

a hub; and blades extending radially outwards from the hub between a blade root and a blade tip, the blades of said ventilation blower wheel having a backward/forward curvature from a reversal in curvature along a span distance of said blades, wherein the span distance is a length from the blade root to the blade tip, wherein said blades comprise, between 20% and 80% along said span distance, at least one pitch variation, extending over a maximum span distance of 25%, of at least 2° more or less than a linear pitch over said span distance, and, wherein a peak in the at least one pitch variation is positioned a distance from a curvature reversal point, wherein the distance is less than or equal to 30% of the span distance of the blades, and one or more heat exchangers through which an air flow generated by the blower wheel passes.

15. The car cooling system as claimed in claim 14, wherein the blower wheel is located upstream from the one or more heat exchangers.

16. The car cooling system as claimed in claim 14, wherein the one or more heat exchangers are aligned along an axis of rotation of the blower wheel.

17. The ventilation blower wheel as claimed in claim 1, wherein the at least one pitch variation is located in an area of the span distance close to a point of maximum backward curvature of said blades.

18. The ventilation blower wheel as claimed in claim 1, further comprising a peripheral rotating guide, in a form of a cylindrical ring, to which the blade tip of said blades are attached.

* * * * *